US005298151A

United States Patent [19]

Steinberg et al.

[11] Patent Number: 5,298,151

[45] Date of Patent: Mar. 29, 1994

[54] EBULLATED BED HYDROPROCESSING OF PETROLEUM DISTILLATES

[75] Inventors: Robert M. Steinberg; Jacquelyn G. Niccum; John C. Strickland, all of Houston, Tex.

[73] Assignee: Texaco Inc., White Plains, N.Y.

[21] Appl. No.: 978,615

[22] Filed: Nov. 19, 1992

[51] Int. Cl.[5] ..... C10G 45/00

[52] U.S. Cl. ..... 208/95; 208/100; 208/143; 208/153; 208/157; 208/159; 208/163

[58] Field of Search ..... 208/95, 100, 143, 153, 208/157, 159, 163, 213, 250, 251 H, 254 H, 302, 350, 353, 358, 365

[56] References Cited

U.S. PATENT DOCUMENTS

| | | | |
|---|---|---|---|
| Re. 25,770 | 4/1965 | Johanson | 208/143 |
| 2,100,353 | 11/1937 | Pier et al. | 208/108 |
| 2,724,683 | 11/1955 | Nadro Jr. | 208/213 |
| 2,935,374 | 5/1960 | Brooks | 208/159 |
| 3,119,765 | 1/1964 | Corneil et al. | 208/213 |
| 3,471,582 | 10/1969 | Lupfer | 208/143 |
| 4,292,140 | 9/1981 | Kawasaki et al. | 208/353 |
| 4,427,535 | 1/1984 | Nongbri et al. | 208/112 |
| 4,913,800 | 4/1990 | Sayles et al. | 208/108 |
| 5,039,396 | 8/1991 | Steinberg et al. | 208/143 |

*Primary Examiner*—R. Bruce Breneman
*Assistant Examiner*—Walter D. Griffin
*Attorney, Agent, or Firm*—James L. Bailey; Kenneth R. Priem; Richard A. Morgan

[57] ABSTRACT

In ebullated bed hydroprocessing of a distillate hydrocarbon feedstock, it has been found that high pressure and low pressure heat exchange can be separated. Both the high pressure heat exchange and the fired heater fuel consumption are reduced. A control system provides for a constant distillate feedstock temperature in cooperation with heat integration.

7 Claims, 1 Drawing Sheet

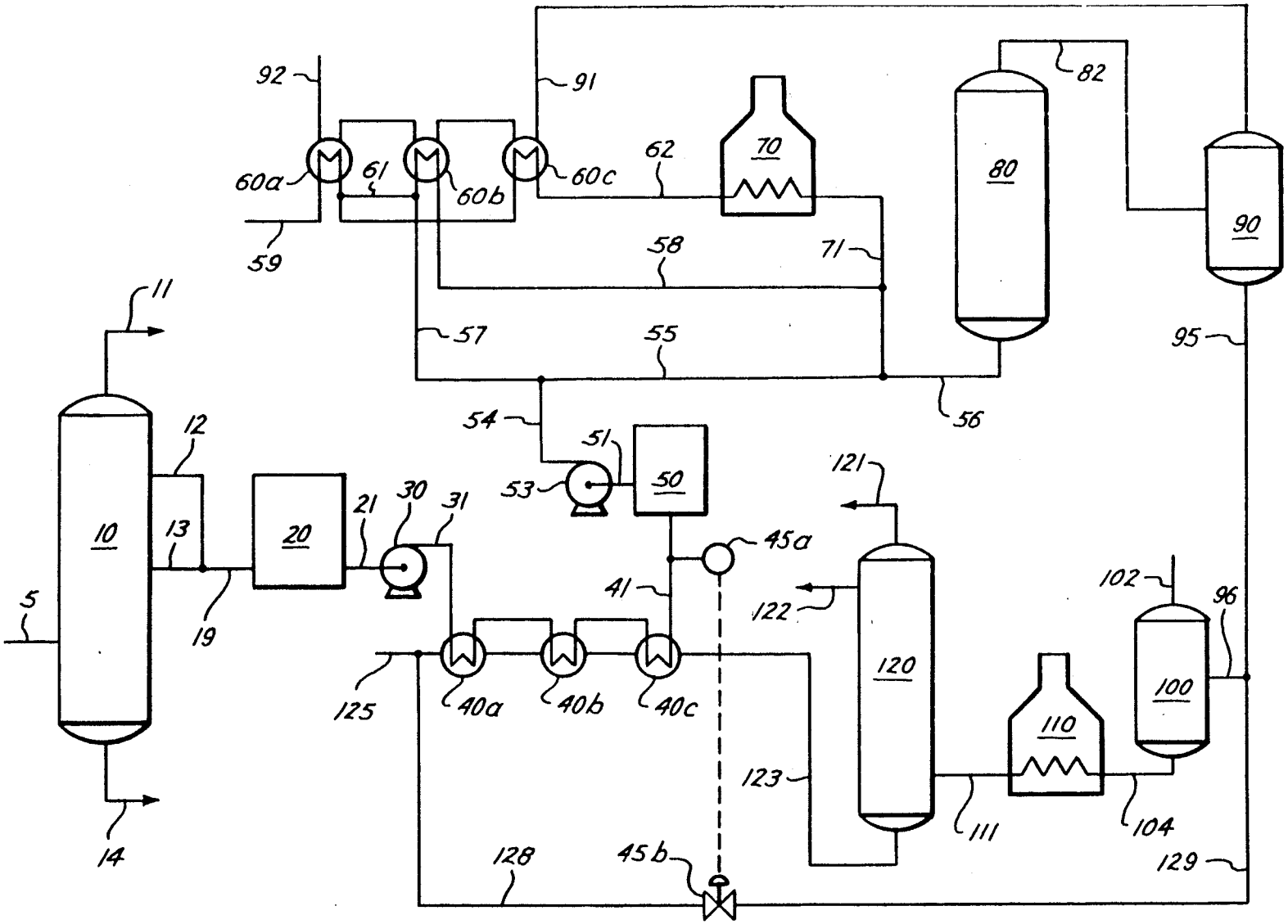
90
95
96
100
102
104
129
82
80
110
111
56
120
121
122
123
71
70
45a
45b
62
58
55
50
41
40c
40b
40a
91
60c
51
53
54
128
60b
57
31
30
21
125
61
92
60a
59
20
19
12
13
11
10
14
5

EBULLATED BED HYDROPROCESSING OF PETROLEUM DISTILLATES

BACKGROUND OF THE INVENTION

1. Field Of The Invention

The invention relates to a hydroprocessing a petroleum distillate in an ebullated bed reactor.

2. Description Of Other Related Methods In The Field

Hydroprocessing is used in petroleum refineries to hydrogenate petroleum derived stocks. Hydrogenation removes sulfur, nitrogen, metals and other undesirable contaminants from the stock. Hydrogenation also saturates olefinic and aromatic compounds rendering the stock more stable to thermal degradation as well as stabilizing color. Hydroprocessing at more severe conditions is used to both hydrogenerate stocks as well as effect mild hydrocracking.

Hydroprocessing is typically carried out in a packed bed of catalyst. Hydroprocessing catalysts typically comprise a Group VI metal or a Group VIII metal such as nickel, cobalt or molybdenum on a porous solid support. Cobalt-molybdenum and nickel-molybdenum on an aluminum support are in wide commercial use in the industry for this purpose. The hydroprocessing reaction is carried out at a hydrogen partial pressure of 100 psia (6.8 atm) to 3000 psia (204 atm) and a temperature of 400° F. (204° C.) to 850° F. (454° C.).

A fixed bed hydrotreater typically comprises a charge pump, a make-up hydrogen compressor, feed-/effluent and hydrogen/effluent heat exchanges, a charge heater, one or more reactors, product separators, a recycle hydrogen compressor and product fractionators.

An advancement in the art of packed bed hydrotreating is described in U.S. Pat. No. 5,039,396 to R. M. Steinberg et al.

The ebullated bed process comprises the passing of concurrently flowing streams of liquids or slurries of liquids and solids and gas upwardly through a vertically elongated cylindrical vessel containing a catalyst bed. The catalyst in the bed is maintained in random motion in the liquid and has a gross volume dispersed through the liquid greater than the volume of the catalyst when stationary. This technology has been used commercially in the upgrading of heavy liquid hydrocarbons or converting coal to synthetic oils.

The process is generally described in U.S. Pat. No. 25,770 to Johanson incorporated herein by reference. A mixture of hydrocarbon liquid and hydrogen is passed upwardly through a bed of catalyst particles at a rate such that the particles are forced into random motion as the liquid and gas flow upwardly through the bed. The random catalyst motion is controlled by recycle liquid flow so that at steady state, the bulk of the catalyst does not rise above a definable level in the reactor. Vapors along with the liquid which is being hydrogenated are removed at the upper portion of the reactor.

The ebullated bed process has been found to be applicable to hydrocracking petroleum derived hydrocarbon distillate fractions. U.S. Pat. No. 5,108,580 to G. Nongbri et al. teaches an ebullated bed for hydrocracking a heavy vacuum gas oil fraction. This distillate fraction is recycled to extinction between an ebullated bed hydrocracker and a fluid catalytic cracker (FCC).

SUMMARY OF THE INVENTION

A distillate hydrocarbon feedstock is continuously hydroprocessed with a hydrogen-containing gas in a reactor vessel containing an ebullated bed of particulate catalyst. The catalytic hydrotreating reaction is carried out at a reaction temperature of 650° F. (343° C.) to 950° F. (510° C.) and reaction pressure of 600 psia (41 atm) to 3000 psia (204 atm) to produce a reaction effluent which is separated to yield an unreacted hydrogen-containing gas and a liquid hydrocarbon reactor effluent.

The distillate hydrocarbon feedstock is heated to a feedstock temperature of about 500° F. (260° C.) to 600° F. (315° C.) at a pressure of about 20 psia (1.4 atm) to 200 psia (13.6 atm) by heat exchange and flowed to the reactor. The reactor effluent is separated to yield an unreacted hydrogen-containing gas and a liquid hydrocarbon reactor effluent.

The liquid hydrocarbon reactor effluent is heated to its bubble point or higher in a fractionation heater and fractionated to yield at least two fractions comprising (i) a hydrotreated product, e.g. light distillate and (ii) the hot bottoms fraction, e.g. heavy distillate.

The hot bottoms fraction is cooled by heat exchange with the distillate hydrocarbon feedstock. A portion of this cooled bottoms fraction is recycled to the fractionation heater in an amount proportional to the difference between the feedstock temperature and a selected setpoint temperature.

Hydrogen-containing gas is subjected to two stages of heating and passed to the reactor. The first stage is heat exchange with the unreacted hydrogen-containing gas. The second stage is heating in a fired heater to a temperature of 800° F. (427° C.) to 1000° F. (538° C.). Both stages are at a pressure of about 600 psia (41 atm) to 3000 psia (204 atm).

As a result, hydrogen-containing gas is heated by heat exchange at a high pressure of 600 psia (41 atm) to 3000 psia (204 atm) while the distillate hydrocarbon feedstock is heated by heat exchange at a only moderate pressure of 20 psia (1.4 atm) to 200 psia (13.6 atm), preferably 20 psia (1.4 atm) to 50 psia (3.4 atm). The process is also heat integrated between the hydrotreating reaction and fractionation of the liquid hydrocarbon reactor effluent.

BRIEF DESCRIPTION OF THE DRAWING

The drawing is a schematic process flow diagram for carrying out the invention.

DETAILED DESCRIPTION OF THE INVENTION

Feedstocks for the process are derived from crude petroleum. The source of the crude petroleum is not critical; however, Arabian Light and West Texas intermediate are preferred feedstocks in the petroleum refining industry because these petroleums are rather light and have a relatively low viscosity compared with other whole crude petroleums. The viscosity of Arabian Light petroleum is about 1.0 cp at 280° F. (137° C.) with a gravity of about 34.5° API. Other whole crude petroleum having a gravity of between about 33° API and 36° API are preferred and are considered premium grade because of their low gravity. In general crude petroleum having a gravity of 30° API and lighter are desirable. Crude petroleum having a gravity of 20° API and heavier are less desirable though they may be used as feedstocks to produce intermediate distillates for the process.

Crude petroleum is subjected to fractional distillation in fractional distillation towers including a pipe still and a vacuum pipe still with lesser associated distillation towers. The resulting fractions range from the lightest hydrocarbon vapors to the heaviest vacuum residuum fraction having an initial boiling point of about 1100° F. (593° C.). Intermediate between propane and propylene and the heavy vacuum residuum fraction are a number of intermediate fractions which are referred to in the art as distillate fractions. The boiling ranges of each of these distillate fractions is determined by refinery configuration and product demand. These distillate fractions typically include gasoline, naphtha, kerosene, diesel oil, gas oil and vacuum gas oil.

With reference to the drawing, a crude petroleum is passed via line 5 to crude petroleum fractionation zone 10 and subjected to atmospheric and vacuum distillation to produce light, hydrocarbon vapors withdrawn via line 11, light distillates withdrawn via line 12, heavy distillates withdrawn via line 13 and a vacuum residuum bottoms fraction withdrawn via line 14.

The light hydrocarbon vapors include methane, ethane, ethylene, propane and propylene. Light distillates include gasoline, naphtha, kerosene and diesel oil. Heavy distillates include gas oil and vacuum gas oil.

Typically, gasoline has a boiling range of about $C_4$ 30° F. (−1.1° C.) to 360° F. (182° C.). Naphtha has a boiling range of 90° F. (32.2° C.) to 430° F. (221° C.). Kerosene has a boiling range of 360° F. (182° C.) to 530° F. (276° C.). Diesel has a boiling range of 360° F. (182° C.) to about 650° F. to 680° F. (343° C. to 360° C.). The end point for diesel is 650° F. (343° C.) in the United States and 680° F. (360° C.) in Europe. Gas oil has an initial boiling point of about 650° F. to 680° F. (343° C. to 360° C.) and end point of about 800° F. (426° C.). The end point for gas oil is selected in view of process economics and product demand and is generally in the 750° F. (398° C.) to 800° F. (426° C.) range with 750° F. (398° C.) to 775° F. (412° C.) being most typical. Vacuum gas oil has an initial boiling point of 750° F. (398° C.) to 800° F. (426° C.) and an end point of 950° F. (510° C.) to 1100° F. (593° C.). The end point is defined by the hydrocarbon component distribution in the fraction as determined by an ASTM D-86 or ASTM D-1160 distillation. The gasoline, naphtha, kerosene and diesel portion is used for liquid fuel. The gas oil and vacuum gas oil portion is subjected to fluid catalytic cracking (FCC) or other refining process to upgrade its value or is blended with lighter fractions for use as liquid fuel.

The boiling ranges of distillate hydrocarbon fractions are subject to change. For example, the initial boiling point and boiling range distribution of gasoline is subject to federal regulation. Also, the end point of vacuum gas oil is influenced by the component distribution in the crude petroleum from which it is derived The initial boiling point and end point of distillate fractions is not critical to the invention. The invention is applicable to distillate hydrocarbon fractions which are vaporized when subjected to vacuum distillation in a pipe still and are then recovered as overhead or side stream fractions as liquids when reduced to atmospheric temperature and pressure.

Specifically excluded from the invention are hydrocarbon fractions referred to as residuum. Residuum includes petroleum atmospheric distillation bottoms, vacuum distillation bottoms, deasphalter bottoms, shale oil residues, tar sand extracts, bitumen, hydrocarbon residues, and mixtures comprising these residua all represented in the drawing as the vacuum residuum bottoms fraction withdrawn from petroleum fractions from petroleum fractionation zone 10 via line 14.

It is typical that the distillate hydrocarbon fractions are passed first via line 19, individually or in partially separated mixture to intermediate tankage shown collectively in the drawing as tank 20. For example gasoline, naphtha, kerosene and diesel oil may be accumulated individually in separate tanks. A heavy distillate mixture of gas oil and vacuum gas oil may be accumulated in a single tank.

These distillate hydrocarbon fractions are hydroprocessed in an ebullated bed reactor to reduce the sulfur, nitrogen, metals content and unsaturation of these fractions. Catalytic hydroprocessing conditions include a temperature of 650° F. (343° C.) to 950° F. (510° C.), hydrogen partial pressure of 600 psia (41 atm) to 3000 psia (204 atm) and liquid hourly space velocity (LHSV) in the range of 0.25 to 3.0.

Distillate hydrocarbon feedstock is withdrawn at ambient temperature from tank 20 via line 21 and passed via feedstock addition pump 30, line 31, feed/bottoms heat exchangers 40*a*, 40*b*, 40*c* and line 41 to surge drum 50. Pump 30 raises the pressure of feedstock from about 14.7 psia (1 atm) to about 20 psia (1.4 atm) to 200 psia (13.6 atm), preferably 20 psia (1.4 atm) to 50 psia (3.4 atm). In feed/bottoms heat exchangers 40*a*, 40*b* and 40*c*, the temperature of distillate hydrocarbon feedstock is raised from about 100° F. (38° C.) to 400° F. (204° C.), to a temperature of about 500° F. (260° C.) to 600° F. (315° C.), measured by temperature sensor, indicator and controller 45*a*. This is accomplished by passing the feedstock through the tube side of shell and tube feed/bottoms heat exchangers 40*a*, 40*b*, and 40*c*. On the shell side of the heat exchangers is a hot bottoms fraction, at a temperature of 650° F. (343° C.) to 800° F. (426° C.), more fully discussed below. The transfer of heat from the hot gas oil bottoms fraction heats the feedstock to the required temperature.

Pump 53 withdraws hot feedstock via line 51 from surge drum 50 and increases the pressure to at least 600 psia (41 atm) to 3000 psia (204 atm), the pressure required for the hot feedstock to enter reactor vessel 80. The hot, pressured feedstock enters reactor vessel 80 by either of two routes. By the preferred first route; feedstock flows via line 54, line 55 and line 56 into reactor vessel 80. By the second route, feedstock flows via line 54, line 57, heat exchanger 60*b*, line 58, line 71 and line 56 into reactor vessel 80. In this second route, additional heat is added to the feedstock by heat exchange with hot unreacted hydrogen-containing gas from reactor vessel 80. An amount of hydrogen-containing gas is injected into the feedstock via line 61 to suppress the formation of coke on the tube surface which is at a temperature of about 500° F. (260° C.) to 650° F. (343° C.). This second route is less preferred because the shell side of the heat exchanger 60*b* is at high pressure, reduced from the pressure in reactor vessel 80.

A hydrogen-containing gas comprises at least 70 vol % hydrogen, preferably at least 85 vol % hydrogen. The hydrogen-containing gas enters the process via line 59 at ambient temperature to about 200° F. (93° C.) and a pressure of at least 600 psia (41 atm) to 3000 psia (204 atm) provided by a hydrogen compressor (not shown) dedicated to this service. The hydrogen-containing gas passes through heat exchangers 60*a* and 60*c* where the temperature is raised from ambient temperature to a furnace inlet temperature of 550° F. (288° C.) to 800° F. (426° C.) by heat exchange with a hot unreacted hydrogen-containing gas. The heated hydrogen-containing gas is withdrawn from heat exchanger 60c via line 62 and passed through the furnace tubes in fired furnace 70 where more heat may be added to raise the temperature to a furnace outlet temperature of 800° F. (427° C.) to 1000° F. (538° C.). The heat in fired furnace 70 is provided by the combustion of fuel oil or a fuel gas such as butane, propane, or mixture of light fuel gas hydrocarbons. The hot, high pressure gas is passed, via line 71 and line 56 into reactor vessel 80.

Reactor vessel 80 contains an ebullated bed of particular hydroprocessing catalyst at hydroprocessing reaction conditions. Hydroprocessing reaction conditions include a temperature of 650° F. (343° C.) to 950° F. (510° C.), hydrogen partial pressure of 600 psia to (41 atm) to 3000 psia (204 atm) and liquid hourly space velocity (LHSV) within the range of 0.25 to 3.0 volume of feed/hour/reactor volume. The hydroprocessing reaction includes both hydrotreating and mild hydrocracking. Hydrotreating is preferably carried out at a temperature of 720° F. (382° C.) to 760° F. (404° C.) and a reaction pressure of 800 psia (54 atm) to 1200 psia (82 atm). Mild hydrocracking is preferably carried out at a temperature of 760° F. (404° C.) to 830° F. (443° C.) and reaction pressure of 1000 psia (68 atm) to 2000 psia (136 atm).

Preferable ebullated bed hydroprocessing catalyst comprises active metals, for example Group VIB salts and Group VIIIB salts on an alumina support of 60 mesh to 270 mesh having an average pore diameter in the range of 80 to 120Å and at least 50% of the pores having a pore diameter in the range of 65 to 150Å. Alternatively, catalyst in the form of extrudates or spheres of ¼ inch to 1/32 inch diameter may be used. Group VIB salts include molybdenum salts or tungsten salts selected from the group consisting of molybdenum oxide, molybdenum sulfide, tungsten oxide, tungsten sulfide and mixtures thereof. Group VIIIB salts include a nickel salt or cobalt salt selected from the group consisting of nickel oxide, cobalt oxide, nickel sulfide, cobalt sulfide and mixtures thereof. The preferred active metal salt combinations are the commercially available nickel oxide-molybdenum oxide and the cobalt oxide-molybdenum oxide combinations on alumina support.

A mixed phase reactor effluent is withdrawn from the top of the reactor vessel 80 and passed via line 82 to a series of hot and cold, high and low pressure flash separators shown here by way of representation as high pressure separator 90 and low pressure separator 100.

The mixed phase reactor effluent is separated in high pressure separator 90 into an unreacted hydrogen-containing gas withdrawn via line 91 and a liquid hydrocarbon reactor effluent withdrawn via line 95. The flash separation temperature and pressure in high pressure separator 90 are the same as in reactor vessel 80.

The unreacted hydrogen-containing gas is passed via line 91 to heat exchangers 60c, 60b and 60a where, as previously described, the heat is removed by heat exchange with hydrogen-containing gas and optionally heat exchange with distillate hydrocarbon feedstock. The unreacted hydrogen-containing gas is then passed via line 92 to one or two high pressure flash drums (not shown) at a temperature of 500° F. (260° C.) to 100° F. (38° C.) to effect additional separation. Liquids from this separation are passed to fractionation column 120.

The liquid hydrocarbon effluent is passed via line 95 and line 96 into low pressure separator 100 where it is combined with a recycled, cooled gas oil stream via line 129. In low pressure separator 100 any remaining hydrogen and light hydrocarbons are removed by flash separation at flash separation process conditions at a temperature of 600° F. (316° C.) to 750° F. (399° C.) and a pressure of 30 psia (2.0 atm) to 200 psia (13.6 atm). Vapors are withdrawn via line 102. Liquid hydrocarbon is withdrawn via line 104.

Liquid hydrocarbon in line 104 is passed to fired furnace 110 where the hydrocarbon is heated to its bubble point of about 600° F. (315° C.) or a higher temperature, e.g. 650° F. (343° C.) to 800° F. to (426° C.), and passed to fractionation column 120. In fractionation column 120 the hydrocarbon is separated into its component parts such as the lighter distillates, e.g. gasoline, naphtha withdrawn via line 121 and light intermediate distillates, e.g. kerosene, diesel via line 122. The bottoms product is a heavy distillate fraction, e.g. gas oil and vacuum gas oil, withdrawn as a hot bottoms fraction via line 123. This hot bottoms fraction is passed through feed/bottoms heat exchangers 40c, 40b and 40a where heat is removed by heat exchange with ambient temperature feedstock flowing through line 31. A hydroprocessed heavy distillate fraction reduced in temperature is withdrawn from the process via line 125.

It is essential to the process that the hot bottoms fraction in line 123 contain enough heat to raise the temperature of feedstock flowing in lines 31 and 41 to 500° F. (260° C.) to 600° F. (315° F.). Heat is supplied to this fraction in fired furnace 110. The temperature is limited by vapor-liquid equilibrium and by thermal cracking to form coke above temperatures of 750° F. (399° C.) to 800° F. (427° C.) in fired furnace 110 and fractionation column 120. It has been found that additional heat is made available in feed/bottoms heat exchangers 40a, 40b and 40c by increasing the flow volume of hot bottoms fraction. This is accomplished by recycling a portion of cooled bottoms fraction via line 128, line 129 and line 96 to low pressure separator 100.

The amount of recycle is regulated by control valve 45b in cooperation with temperature sensor, indicator and controller 45a. Temperature controller 45a provides a signal to control valve 45b proportional to the difference between the feedstock temperature and a selected temperature in the required range of 500° F. (260° C.) to 600° F. (315° C.). It is apparent that furnace 110 firing can be adjusted so that feedstock is heated to the required reactor inlet temperature in feed/bottoms heat exchangers and high pressure heat exchange in heat exchanger 60b can be avoided.

EXAMPLE

Both a fixed bed hydrotreater and an ebullated bed hydrotreater according to the invention were designed for a vacuum gas oil feedstock at a rate of 55,000 bb/day. The ebullated bed hydroprocess was designed with minimal feedstock heat exchange at high pressure. The difference in heat duty and the associated equipment sizes for the two designs is shown by comparison:

| | Fixed Bed | Ebullated Bed |
|---|---|---|
| Charge Rate, bbl/day | 55,000 | 55,000 |
| Fired Furnace 70, | | |

-continued

| | Fixed Bed | Ebullated Bed |
|---|---|---|
| Design Duty, MMBtu/hr | 71.60 | 44.38 |
| Normal Duty, MMBtu/hr | 58.14 | 15.27 |
| Heat Exchangers 60a, 60b, 60c | | |
| Shells Required | 11 | 3 |
| Surface Area, $ft^2$ | 35,287 | 5,922 |
| Fractionator Feed Heater 110, | | |
| Design Duty, MMBtu/hr | 62.53 | 46.07 |
| Normal Duty, MMBtu/hr | 51.79 | 7.79 |
| Feed/Bottoms Exchangers 40a, 40b, 40c | | |
| Shells Required | 9 | 7 |
| Surface Area, $ft^2$ | 30,786 | 24,625 |

By the invention, 83% of the expensive (high alloy) high pressure heat exchange surface area was eliminated compared to the fixed bed hydroprocessor. By the invention 79% of the heat added by fuel gas firing was eliminated.

While particular embodiments of the invention have been described, it will be understood, of course, that the invention is not limited thereto since many modifications may be made, and it is, therefore, contemplated to cover by the appended claims any such modification as fall within the true spirit and scope of the invention.

What is claimed is:

1. A method of hydroprocessing a distillate hydrocarbon feedstock with a hydrogen-containing gas in an ebullated bed of particulate catalyst at a reaction temperature of 650° F. (343° C.) to 950° F. (510° C.) and reaction pressure of 600 psia (41 atm) to 3000 psia (204 atm) and separating to yield an unreacted hydrogen-containing gas and a liquid hydrocarbon reactor effluent comprising:

a. heating the hydrogen-containing gas to a temperature of about 800° F. (427° C.) to 1000° F. (538° C.) at a pressure of about 600 psia (41 atm) to 3000 psia (204 atm) by first heat exchange with the unreacted hydrogen-containing gas and second heat exchange in a fired heater, and then flowing the gas to the ebullated bed;

b. heating the liquid hydrocarbon reactor effluent and fractionating to yield at least two fractions comprising:

(i) a hydrotreated lighter product, and (ii) a hot hydrotreated bottoms fraction;

c. heating the distillate hydrocarbon feedstock to a feedstock temperature of about 500° F. (260° C.) to 600° F. (315° C.) at a pressure of about 20 psia (1.4 atm) to 200 psia (13.6 atm) by heat exchange with the hot hydrotreated bottoms fraction to produce a cooled bottoms fraction and then flowing the feedstock to the ebullated bed;

d. recycling the cooled bottoms fraction of step c. to the heating of step b. in an amount proportional to the difference between the feedstock temperature and a selected temperature in the range of about 500° F. (260° C.) to 600° F. (315° C.).

2. The method of claim 1 wherein step c. all heating of the distillate hydrocarbon feedstock is carried out at 20 psia (1.4 atm) to 200 psia (13.6 atm).

3. The method of claim 1 wherein in step c. all heating of the distillate hydrocarbon feedstock is carried out at a pressure of about 20 psia (1.4 atm) to 50 psia (3.4 atm).

4. The method of claim 1 wherein the hot hydrotreated bottoms fraction is gas oil, vacuum gas oil, or mixture thereof.

5. The method of claim 1, wherein the hydrotreated lighter product is gasoline, naphtha, kerosene, diesel or mixture thereof.

6. The method of claim 1 wherein the reaction temperature is 720° F. (382° C.) to 760° F. (404° C.) and reaction pressure is 800 psia (54 atm) to 1200 psia (82 atm).

7. The method of claim 1 wherein the reaction temperature is 760° F. (404° C.) to 830° F. (443° C.) and reaction pressure is 1000 psia (68 atm) to 2000 psia (136 atm).

* * * * *